United States Patent [19]

Venetta

[11] 4,299,566

[45] Nov. 10, 1981

[54] METAL PREHEAT CONVEYOR WITH IMPROVED AIR FLOW PROPERTIES

[76] Inventor: Henry J. Venetta, 9613 Holland Springs Rd., Warren, Ohio 44494

[21] Appl. No.: 113,111

[22] Filed: Jan. 17, 1980

[51] Int. Cl.[3] ..... F27D 3/12

[52] U.S. Cl. ..... 432/241; 432/88; 432/134

[58] Field of Search ..... 432/11, 88, 134, 241; 34/164

[56] References Cited

U.S. PATENT DOCUMENTS

| | | | |
|---|---|---|---|
| 3,133,628 | 5/1964 | Butler et al. | 432/134 |
| 3,173,768 | 3/1965 | Witte | 34/164 |
| 4,135,702 | 1/1979 | Venetta et al. | 432/11 |

*Primary Examiner*—John J. Camby

*Attorney, Agent, or Firm*—Oldham, Oldham, Hudak & Weber Co.

[57] ABSTRACT

This scrap metal preheat apparatus includes a conveyor made from deck plates which are of generally U-shape in vertical section, and an apertured or wire mesh metal support layer positioned on and conforming to the contour of the interior of the deck plate but spaced therefrom, which deck plate and support screen are of flattened U-shape in section, and supports for the deck plate, the apertured support layer being operatively secured to the supports and/or deck plate at the upper edge portions of the apertured support layer which overlap upper edges of the deck plate, and the apparatus includes support members for the support layer aiding in spacing it from the deck plate.

8 Claims, 3 Drawing Figures

METAL PREHEAT CONVEYOR WITH IMPROVED AIR FLOW PROPERTIES

BACKGROUND OF INVENTION

Heretofore there have been various types of metal preheat conveyors provided and a number of these constructions are in some relatively widespread commercial use today. Such prior structures are evidenced by my own prior U.S. Pat. Nos. 3,721,519 and 3,813,209. In these metal preheat conveyors, there sometimes have been difficulties with the supply of sufficient air to the bottom portion of the material being preheated as to insure its complete cleansing by oxidation of impurities on the surfaces of the scrap metal. My prior U.S. Pat. No. 4,135,702 provides one method and apparatus for preheating scrap utilizing a supply of auxiliary air to the materials in the lower portion of the preheat conveyor.

Naturally, it is desirable to preheat the scrap metal or other metals as rapidly as possible, and it also is very desirable to clean off or burn off any and all combustible materials on the scrap so that the supply of secondary air, or combustion air, to the materials in the lower part of the preheat conveyor is an essential factor to be considered in the design of metal scrap preheat conveyors.

The present apparatus is of the type shown in my above-identified patents and it also utilizes a scrap preheat conveyor generally as shown in my companion co-pending application Ser. No. 100,966, filed Dec. 6, 1979, which shows a desirable construction for securing the different sections of the scrap preheat conveyor to a support mechanism.

OBJECTS OF INVENTION

The general object of the present invention is to provide a new and improved conveyor construction for preheating scrap metal and the like and, especially, to a conveyor of this type wherein improved means are present for supply of air or secondary gases to materials in a lower portion of the scrap conveyor.

Another object of the invention is to use some type of an apertured layer in the metal preheat conveyors for supporting the materials being heated in spaced relationship to the transfer conveyor to facilitate air flow to, around and through the materials being processed.

Another object of the invention is to support metal scrap and other material for preheat action in a conveyor by means of a metal mesh structure operatively associated with individual deck plates of a metal conveyor, which support mesh screen is spaced from support areas of the metal deck plate or plates of the conveyor.

Further objects of the invention are to provide a modified scrap metal conveyor that is particularly adapted for preheating scrap metal and the like efficiently, and for facilitating combustion of any combustible materials on the scrap metal being preheated.

The foregoing and other objects and advantages of the invention will be made more apparent as the specification proceeds.

Reference now is particularly directed to the accompanying drawings, wherein.

SUBJECT MATTER OF INVENTION

A metal preheater conveyor apparatus comprising a metal deck plate of generally U-shape in vertical section; support means for the deck plate which apparatus is characterized by an apertured metal support layer positioned adjacent but spaced from the inside surface of the deck plate and means that operatively attach upper edge portions of the support layer to the deck plate, wherein such attaching means comprise metal angles engaging the support means and also engaging the support layer upper edge portions to affix such support layer in position in the apparatus, the support means for the deck plates usually comprising saddle plates extending transversely of the deck plates at longitudinally spaced portions thereof and such metal angles may be secured to the saddle plates at the upper margins thereof.

Attention is now directed to the details of the apparatus shown in the accompanying drawings, and a scrap metal preheat furnace apparatus is indicated as a whole by the numeral 10. This furnace is of the type shown by prior U.S. Pat. No. 3,721,519 and it includes an oven or furnace chamber 12 that mounts a plurality of suitable burners 14 on an upper roof area thereof. Any known conventional means supply these burners 14 with combustible materials so that burning gases and flames are impinged downwardly of the oven for heating any metal or other materials received in the furnace chamber.

Figure 1:
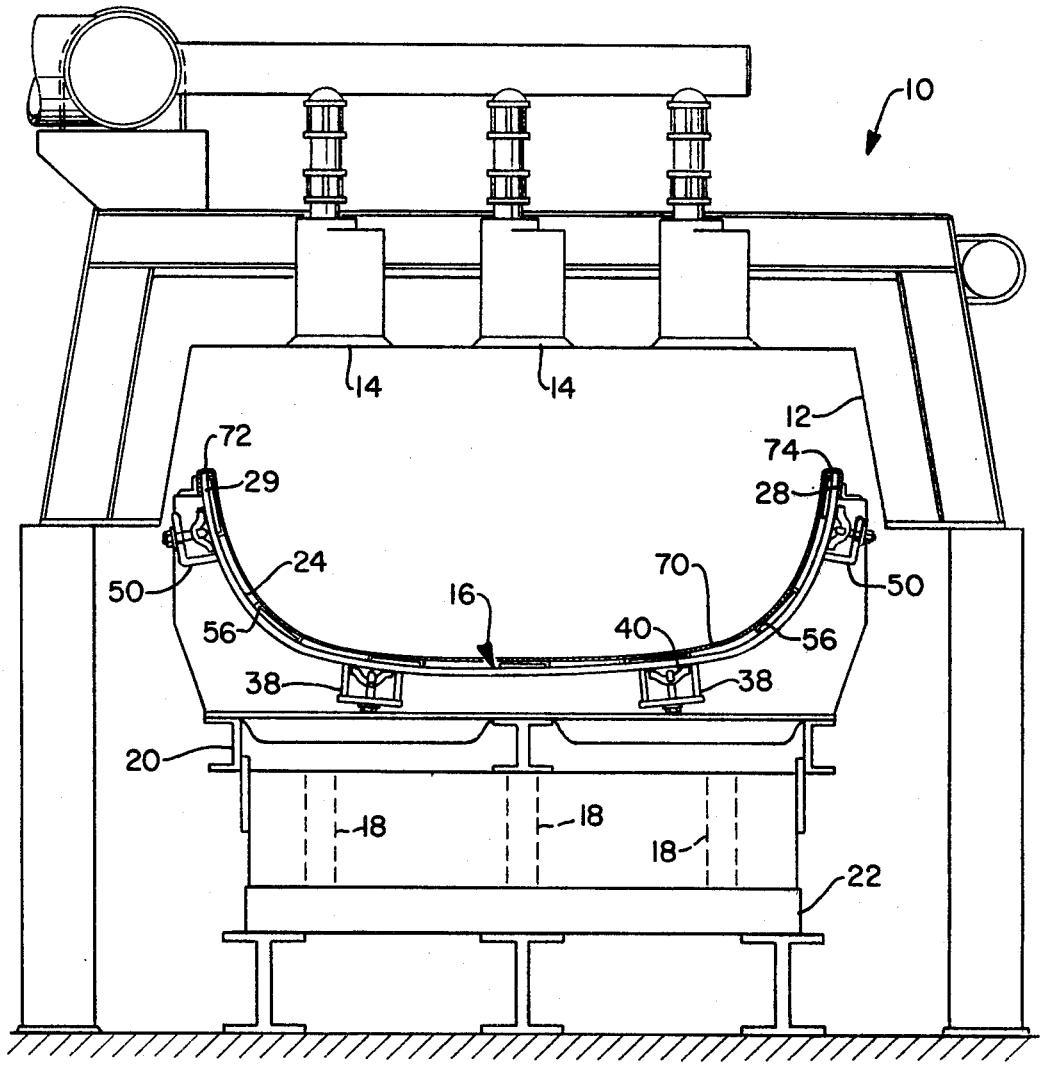
FIG. 1 is a fragmentary vertical section of a metal scrap preheat conveyor and associated furnace means indicated diagrammatically and embodying the principles of the invention.
Figure 2:
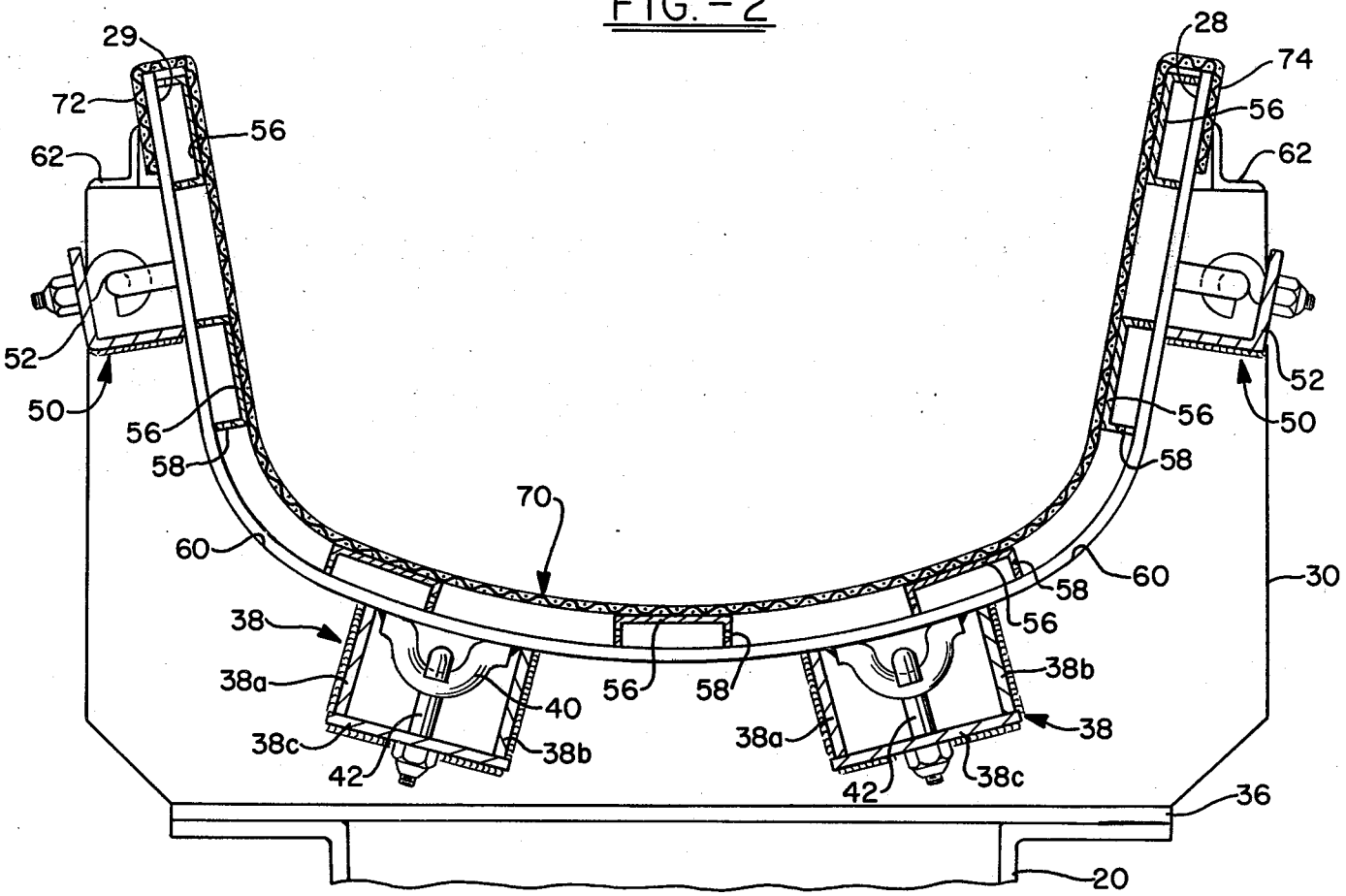
FIG. 2 is a vertical section of the improved conveyor of the invention taken on line 2—2 of FIG. 3.
Figure 3:
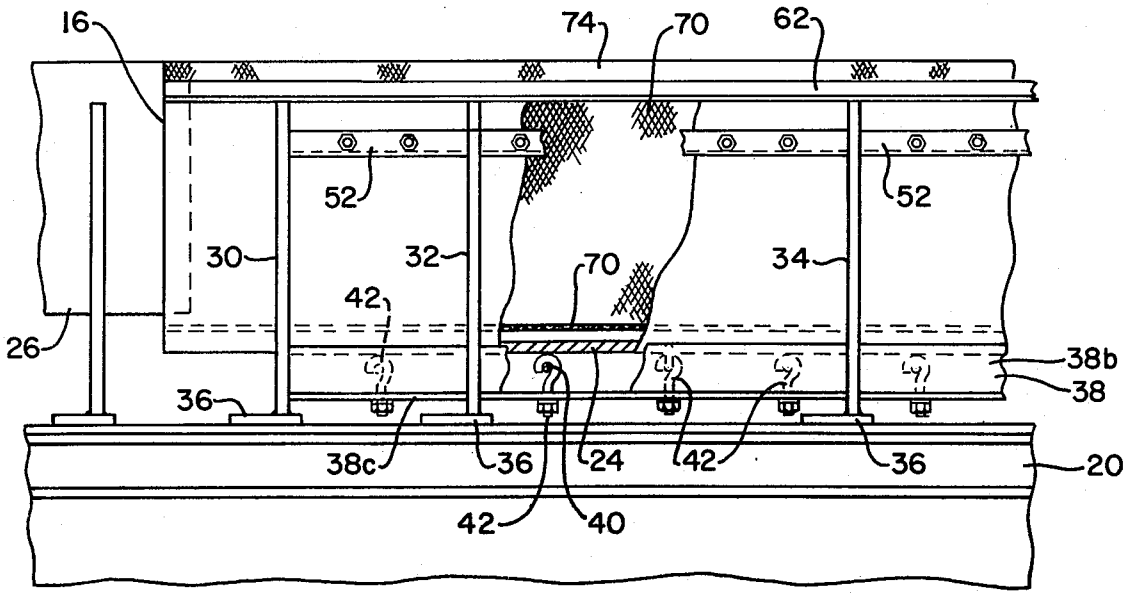
FIG. 3 is a fragmentary side elevation of the scrap conveyor of FIG. 1.

Extending longitudinally of the chamber is a metal transfer and/or carrier conveyor means 16 which usually is mounted on a plurality of conventional coil springs or the like shown diagrammatically at 18 in FIG. 1. Any known type of drive means can connect to base beams 20 or the like for the conveyor means 16 and provide an intermittent jog-type drive thereto or other drive action may be provided as desired. The conveyor also has base support members 22 on which the lower ends of the springs are attached to mount the conveyor resiliently to facilitate jogging or bumping the material, such as the scrap metal, in the conveyor to move it longitudinally of the furnace chamber in a known manner. Usually this conveyor means 16 comprises a plurality of longitudinally overlapped deck plates 24, 26 as indicated in FIG. 3 and any suitable number of these plates may be provided. They are generally of a flattened U-shape in vertical section as shown in FIGS. 1 and 2. These deck plates may be said to be of elliptical shape in cross section and they generally are just smoothly curved from an upper edge 28 thereof to the opposite upper edge 29 for forming a receptacle for material to be heated and processed in the apparatus.

In order to position the deck plate or deck plates in the conveyor apparatus, a plurality of transversely extending support members or saddles 30, 32 and 34 are present and normally each deck plate 24 or 26 is supported on at least two of these saddles which are in the form of metal plates. Such plates have lower surfaces suitably secured to cross plates or bars 36 in turn secured to the longitudinally extending support base **20*a*** in the unit.

A plurality of pairs of substantially U-shaped support members or brace units 38 are present and extend between adjacent pairs of saddle plates 30, 32 that are engaged with a common deck plate, each brace unit comprising a pair of support bars 38*a* and 38*b* and a top cover bar 38*c*. These bars 38*a* and 38*b* are welded at their ends to the saddle plates 30 and 32 and more details of such support bars and connection means are shown in my companion application, co-pending, referred to hereinbefore. The individual saddle plates and brace units are attached to the deck plates by means of anchor engaging members such as flattened U-shaped braces or anchors 40 that are secured at their ends by welding to an individual deck plate and extends transversely thereof. The center portion of these anchors 40 receive suitable bolt members 42 having one attaching end thereof threaded into engagement with the individual anchors 40 and the opposite ends of the bolt extends through the cover plates 38*c* of the brace unit and are suitably tightly attached thereto so as to operatively engage the various portions of the conveyor and its support means.

A slightly modified type of a brace unit 50 is provided adjacent the upper ends of the deck plate and an angle member 52 is provided for positioning the anchor bolt on the under surface of the deck plate in a manner similar to that of the structure at the lower area of the deck plates.

It will be noted that the upper surfaces of the saddle plates 30, 32 and 34, etc. are contoured as at 60 complementary to the lower surfaces of the individual deck plate for good mechanical engagement between the deck plate and its support saddle.

AIR CIRCULATION MEMBERS

In order to obtain improved flow of secondary air or other gas supply to material being processed in the apparatus of the invention, it is a special feature of the present invention that some type of an apertured metal support layer is provided in the apparatus and is positioned within the deck plate 34. This support layer 70 can be made from any desired metal means and may comprise a metal mesh, a metal screen, an apertured metal plate, a heavy wire screen or layer, or other apertured support layer that is sturdy enough to support a relatively heavy quantity of scrap metal or other material being processed in the conveyor and absorb the pounding, jarring actions to which the conveyor and associated means are subjected to in preheat apparatus to which the present invention relates. This apertured wire mesh or metal support layer 70 has upper end portions 72 and 74 that are bent up over and downwardly of the upper edges 28 and 29 of the deck plate 24, as best shown in FIG. 2. The circulation of air around and under the support layer 70 is facilitated by making such layer of substantially flattened U-shape as is the deck plate 24, but to have the support layer spaced from the deck plate and closely following the inner surface contour thereof. Thus, usually I prefer to attach a plurality of support members such as channels 56, to the deck plates 24 to extend longitudinally thereof. These channels 56 reinforce and strengthen the support layer and can be suitably attached thereto but, preferably, are secured to the deck plate, as by welding. Then, to facilitate air flow around and under the support layer, a plurality of apertures 58 are formed in the legs of the channels. These apertures are provided in suitable size at suitable areas longitudinally spaced in the channels whereby the support layer 70 is positioned in and supported in spaced relationship to the inner surface of the deck plate, but reasonable quantities of air can readily circulate therebetween. Several support channels 56, in transversely spaced relation, are provided on each deck plate.

Normally, these channels 56 are supporting the layer 70 on the deck plate, but the layer 70 can move in relation to such support means to avoid having more fixed connections in this apparatus which is subjected to repeated heating and cooling actions.

The upper edge portions 72 and 74 of the support layer 70 are rigidly secured in place as by being welded to an angle member or anchor means 62 that extend longitudinally of the deck plate, with one of such angles being provided adjacent each edge of the support layer. The angles 62, in turn, are suitably attached by welding, to the transversely extending saddles 30, 32, 34, etc., in the deck plate support to complete the securing or attachment of the support layer to its associated deck plate.

As previously indicated, any suitable number of these deck plates can be provided to make the conveyor of the invention. The deck plates naturally are positioned in overlapping, telescoped relationship to each other and any support layer is naturally provided individually for its associated deck plate.

If desired, a combustion gas supply member or tube can be provided in the apparatus and connect to the deck plate 24 or support layer 70 for supply of combustion air to the space between the support layer and its deck plate. This secondary air flow supply can be of any known type and it would provide additional air to facilitate combustion and burning off or cleaning of the impurities on the scrap metal being heated by the apparatus. Any suitable quantity or pressure of secondary air supply can be used as desired.

By the improvement of the invention, cleaner scrap metal can be provided for use in casting metals or producing steel or other metal materials, as desired. Or, the heating action of the scrap metal may be accelerated so that the improved air flow in the apparatus of the invention provides desirable benefits and results in metal preheats. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. In a metal preheat conveyor apparatus or the like comprising a metal deck plate of generally U-shape in vertical section, and support means for said deck plate and characterized by an apertured support layer positioned adjacent but spaced from the inside surface of said deck plate, said support layer being movable in relation to said deck plate, said support means for said deck plate being positioned below said deck plate, and attaching means operatively attaching only edge portions of said support layer to said support means.

2. In a metal preheat conveyor apparatus as in claim 1 where said attaching means comprise angles engaging said support means and also engaging said support layer to fix said layer in the apparatus.

3. In a metal preheat conveyor apparatus as in claim 1, the provision of support members engaging said support layer and said deck plate to space said layer from said deck plate, said support layer being supported on said deck plate.

4. In metal preheat conveyor apparatus as in claim 3, where said support members have suitable apertures therein to permit air circulation between said layer and said plate.

5. In a scrap metal preheat conveyor or the like comprising a plurality of metal deck plates positioned in longitudinally overlapped relation, support means for said deck plates, said deck plates being of generally U-shape in section, and characterized by a wire screen support layer positioned adjacent the inside surface of said deck plates, support members for said wire screen operatively positioned between said screen and said deck plates to space said screen from said plates and aid in supporting said screen, said support members extending longitudinally of said conveyor and being spaced transversely of said deck plates, and means attaching edge portions of said screen to said support means.

6. In a scrap metal preheat conveyor as in claim 5, where said support members comprise U-shaped channels, the bases of which are normally contacting said screen, and where the legs of said channels are apertured to facilitate air flow around and under said screen, and means secure said channels to said deck plates.

7. In a scrap metal preheat conveyor as in claim 5, where opposed upper edge portions of said screen are bent around and down over upper edges of said deck plates, said support means for said deck plates comprising saddle plates extending transversely of said deck plates at longitudinally spaced portions thereof, and said last named means operatively secure said screen edge portions to said saddle means.

8. In a metal preheat conveyor apparatus or the like comprising a metal deck plate of generally U-shape in vertical section, and support means for said deck plate and characterized by an apertured support layer positioned adjacent but spaced from the inside surface of said deck plate attaching means operatively securing portions of said support layer to said deck plate; and opposed upper edge portions of said support layer being bent around and down over the upper edges of said deck plate, said support means for said deck plate comprising saddle plates extending transversely of said deck plate at longitudinally spaced portions thereof, and said attaching means operatively secure said support layer edge portions of said saddle plates.

* * * * *